US006006456A

United States Patent [19]

Hiromachi et al.

[11] Patent Number: 6,006,456

[45] Date of Patent: Dec. 28, 1999

[54] NOVELTY CARD

[75] Inventors: Akihisa Hiromachi; Toyotsugu Fujimoto, both of Tokyo, Japan

[73] Assignee: Heiwa Creation Co., Ltd., Tokyo, Japan

[21] Appl. No.: 09/112,139

[22] Filed: Jul. 9, 1998

[30] Foreign Application Priority Data

Jul. 11, 1997 [JP] Japan ..... 9-202478

[51] Int. Cl.[6] ..... G09F 1/00

[52] U.S. Cl. ..... 40/124.01; 283/75

[58] Field of Search ..... 40/124.01, 1.5, 40/124.191, 360, 615, 675; 283/904, 75, 76, 77, 78

[56] References Cited

U.S. PATENT DOCUMENTS 4,100,689 7/1978 Broune ..... 283/904 X
4,514,785 4/1985 Parmentier ..... 40/1.5 X

*Primary Examiner*—Terry Lee Melius
*Assistant Examiner*—James M Hewitt
*Attorney, Agent, or Firm*—Jacobson, Price, Holman & Stern, PLLC

[57] ABSTRACT

A novelty card that is suitable for a novelty or financial commodity and is of a value that can be objectively determined. A noble-metal piece is fixed to one side of a card body. The entire card body except for the noble-metal piece is used as a weight to comparatively measure the weight of the noble-metal piece. There is a balancing point where the noble-metal piece and the remainder of the card body are balanced in terms of weight.

6 Claims, 2 Drawing Sheets

NOVELTY CARD

BACKGROUND OF THE INVENTION

The present invention relates to a novelty card having a financial value.

DESCRIPTION OF THE PRIOR ART

Prepaid cards such as telephone cards with graphics printed thereon are commonly used and have value as a kind of novelty card. Like merchandise coupons or gift cards, however, the prepaid card is of value only for certain things and does not have an absolute value.

With respect to such cards, a invention of a commodity-built-in card disclosed in Japanese Patent Application Laid Open No. 4-307085 is known. This card can be used as a gift in an amusement arcade equipped with Pachinko (pinball game) or slot machines. The invention, however, relates to prepaid cards, the value of which has no relation to the amount of gold contained in the card. In addition, users cannot determine the value of the gold contained in this card without close examination, so the noble metal in the invention is only ornamental in this sense.

On the other hand, gold is traded as financial commodities. Conventional pure gold, as a financial commodity, comes in coin form and requires a case, making it rather difficult to carry, store, and handle. Although the value of the gold coin is determined by its size, its mass is not specified, preventing its value from being objectively determined.

SUMMARY OF THE INVENTION

The present invention is provided in view of the above problems, and its object is to provide a novelty card that can be used as a novelty or a financial commodity, is easy to handle, and is of a value (mass) that can be objectively determined.

This object can be attained by a novelty card according to this invention wherein a noble-metal piece is integrally fixed to one side of the card body so that the remainder of the card body can be used as a weight to comparatively measure the weight of the noble-metal piece, and wherein a balancing point is formed at a point at which the noble-metal piece and the remaining part of the card body are balanced in terms of weight.

DETAILED DESCRIPTION OF PREFERRED EMBODIMENTS

A novelty card according to this invention has a financial value. This value is objective and absolute and is provided in the card by a noble-metal piece 12 combined with a card body 10.

The noble-metal piece 12 is made of gold, silver, platinum, iridium, or an other metal, or their alloy, and is molded into a specified shape. Its specific shape is arbitrary but should preferably be suitable for being affixed to the card. For example, the noble-metal piece may be small and plate-shaped, or may have a rectangular or other geometrical or non-geometrical shape.

Several types of noble-metal pieces 12 of a large, medium, or small size and various thicknesses can be provided, with masses of, for example, 1 g, 0.5 g, 0.1 g, or 2 g of gold. For example, a noble-metal piece with a double value is of a constant thickness but has twice the area in order to enable the user to visually determine its mass easily. The noble-metal piece 12 may have thereon a pattern, characters, symbols, or other markings indicating its quality.

Figure 1:
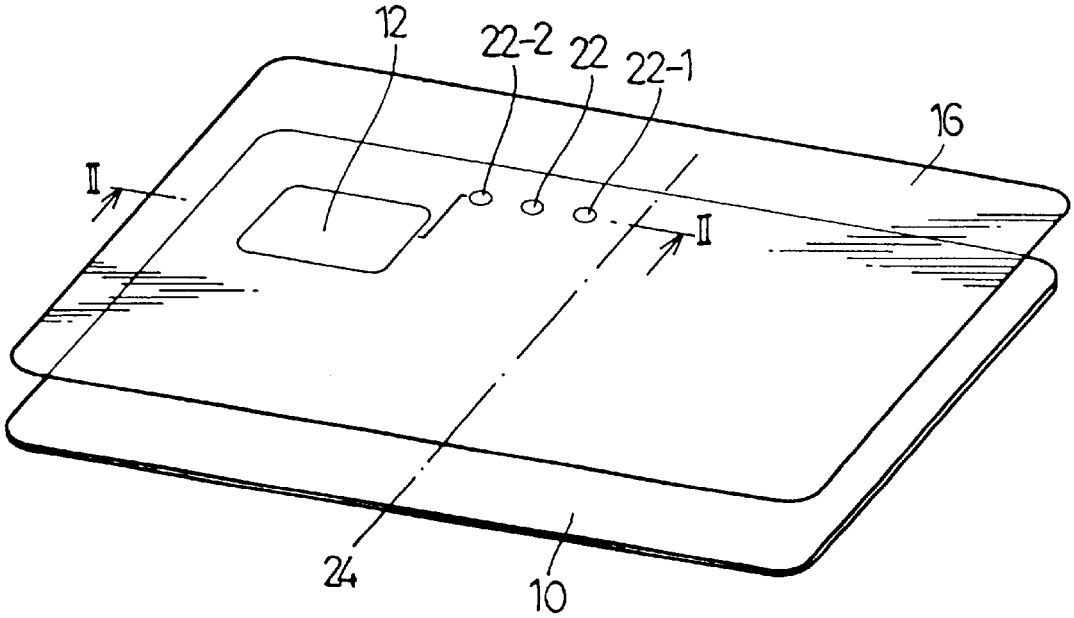
FIG. 1 is an exploded perspective view showing an example of a novelty card according to this invention.
Figure 2:
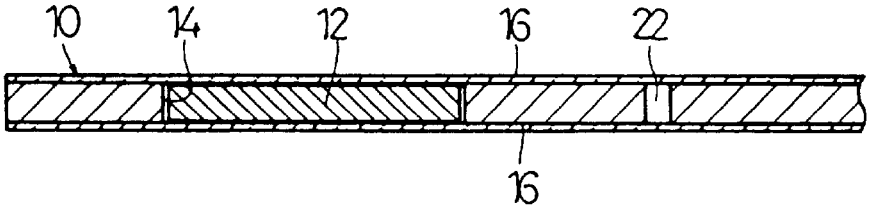
FIG. 2 is a sectional view taken along line II—II in FIG. 1.
Figure 3:
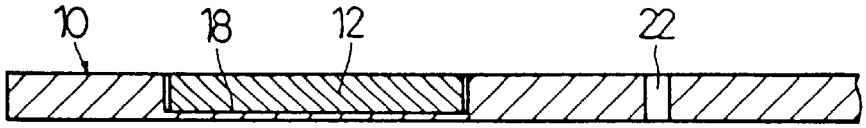
FIG. 3 is a sectional view of a variation of FIG. 2.

The noble-metal piece 12 is fixed to one side of the card body 10. The fixation method is arbitrary, but the noble-metal pieces can be fixed, for example, by means of adhesion, by forming a through-hole 14 in the card body 10, inserting the piece 12 therein, and placing a cover material 16 on the card body (see FIG. 2), by forming a recess 18 in the card body 10 and inserting into and adhering the piece 12 to the card body; or by placing the cover material 16 on the card body 10 without adhesion (see FIG. 3). The cover material 16 may be transparent.

Figure 4:
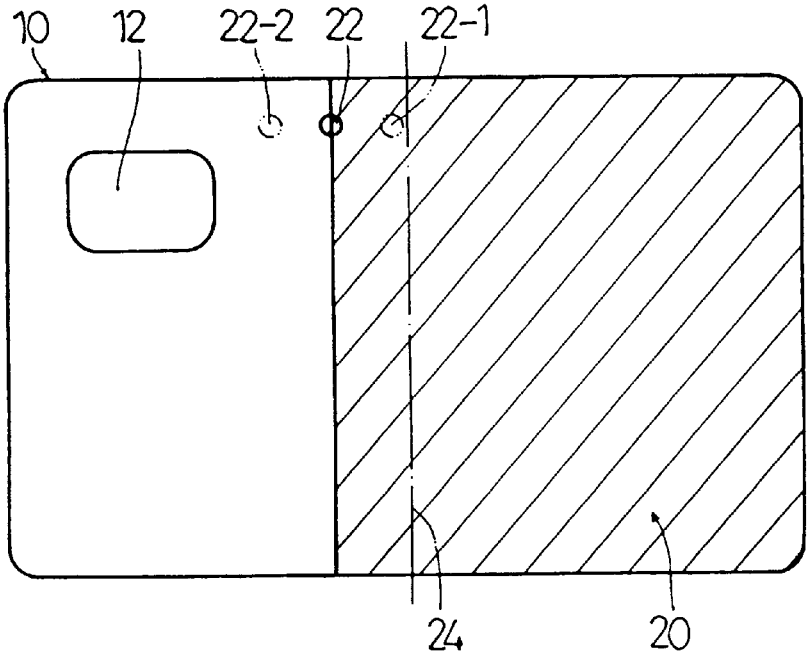
FIG. 4 is a top view of FIG. 3.

To comparatively measure the weight of the noble-metal piece 12, the remainder 20 of the card body 10 (the entire card body except for the noble-metal piece 12) is used as a weight and at least one balancing point 22 is formed at the point at which the noble-metal piece 12 and the remainder 20 of the card body 10 are balanced in terms of weight. Alternatively, the position of the balancing point 22 may simply be marked without forming an opening. The remainder 20 of the card body 10 that is shaded in FIG. 4 is balanced with the total mass of the noble-metal piece 12 and its periphery. Reference numeral 24 indicates the center line.

If the noble-metal piece 12 is lighter (has a smaller mass), the supporting point is located at position 22-1, which is closer to the center line 24, whereas if the piece 12 is heavier (has a larger mass), the supporting point is located at position 22-2, which is closer to the noble-metal piece 12. Accordingly, if the noble-metal piece 12 is placed on the card body 10 and a cover material 16 consisting of a thermocompression bonding film is laminated on the noble-metal piece 12, as shown in the example in FIG. 2, a hole may be opened at the balancing point 22 after lamination.

Figure 5:
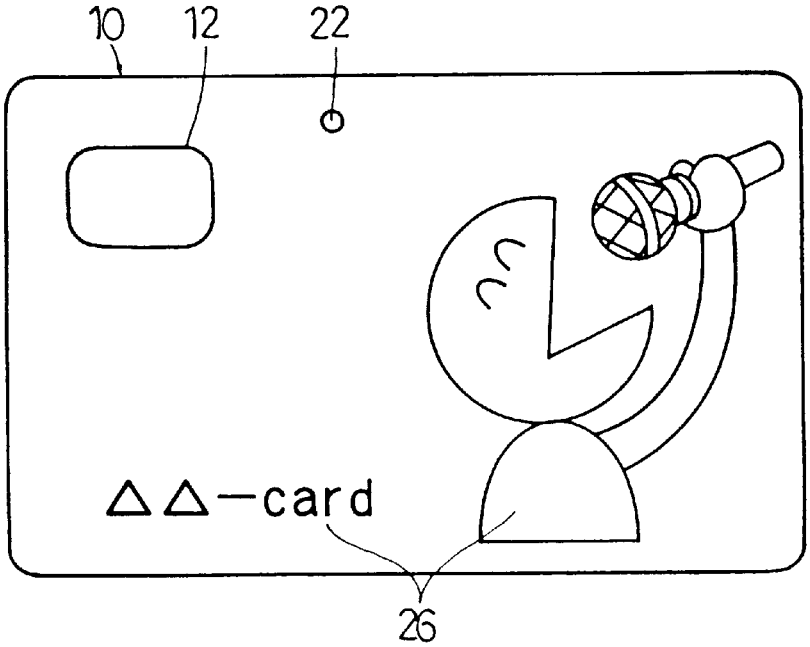
FIG. 5 is a top view showing an example of a novelty card.

Furthermore, a display section 26 including a portion on which the weight, economic value, or type of the noble-metal piece 12 is described can be provided on the card body 10 (see FIG. 5). The display section 26 may include, for example, printed graphics, as in the conventional prepaid cards; a message; or a company name or other advertisement. The card body 10 used in this invention should preferably be business-card sized, but may be of a different size provided that it can be accommodated in a credit-card holder, purse, or pocket. The card body 10 may be composed of plastics or various other materials.

Due to the financial value of the novelty card according to this invention provided by the noble-metal piece 12, users can collect such cards. Since it is sufficiently small to be fixed to the card body 10, the denomination of the noble-metal piece 12 that can be fixed to the card body is limited, making the card easy to afford. In addition, even if the noble-metal piece 12 is separated from the card body 10, it still has its financial value so it can be treated like a normal coin.

Since the present invention is configured and operates as described above, it is easy to carry, store, and handle, and is inexpensive. In addition, its weight function enables its absolute value to be objectively determined, so users can reliably use this card and determine its true value. Therefore, the present invention is suitable for use as a novelty commodity or a financial commodity of a small sum.

What is claimed is:

1. A novelty card having a financial value, said novelty card comprising:

a card body, a noble-metal piece fixed to one side of said card body, a portion of the card body being used as a weight to comparatively measure a weight of said noble-metal piece, and a balancing portion of the card body, spaced from the noble-metal piece and located between the noble-metal piece and the portion of the card body, where the noble-metal piece and the portion of the card body are balanced in terms of weight.

2. A novelty card according to claim 1, wherein said card body has a display section including a description of weight, value, or metal of the noble-metal piece.

3. A novelty card according to claim 1, wherein said noble-metal piece is fixed to one surface of the card body by adhesion.

4. A novelty card according to claim 1, wherein said noble-metal piece is inserted into a through-hole or a recess formed in the card body.

5. A novelty card according to claim 1, wherein said noble-metal piece is covered with a covering material.

6. A novelty card according to claim 1, wherein said financial value of the noble-metal piece is determined by a size of the card body.

* * * * *